US006003536A

United States Patent [19]

Polverari et al.

[11] Patent Number: 6,003,536

[45] Date of Patent: Dec. 21, 1999

[54] AUTOMATIC WATER SHUT-OFF VALVE

[75] Inventors: Paul Polverari, North Andover, Mass.; Stephen M. Wolfhope, Derry, N.H.

[73] Assignee: Watts Investment Company, Wilmington, Del.

[21] Appl. No.: 08/736,190

[22] Filed: Oct. 24, 1996

[51] Int. Cl.[6] ..... F16K 43/00; F16K 31/02; H01H 29/04; H01H 35/18

[52] U.S. Cl. ..... 137/15; 68/12.02; 68/12.19; 68/207; 68/208; 134/57 R; 137/312; 137/360; 137/387; 137/392; 200/61.04; 307/118; 361/178; 29/402.03; 29/890.121

[58] Field of Search ..... 68/207, 208, 12.02, 68/12.16, 12.19, 12.21; 137/15, 360, 312, 315, 387, 392; 200/61.04, 61.05, 83 WM, 84 R; 307/118; 340/604, 605; 361/178; 29/402.03, 890.121; 134/57 R, 57 D, 56 D, 58 R, 58 D; 73/290 R, 304 R, 304 C, 313

[56] References Cited

U.S. PATENT DOCUMENTS

| | | | |
|---|---|---|---|
| 2,952,271 | 9/1960 | Dick et al. | 137/360 |
| 3,148,698 | 9/1964 | Arnold | 137/360 |
| 3,417,782 | 12/1968 | Mentnech | 137/624.11 |
| 3,466,006 | 9/1969 | Livingston | 251/129.01 |
| 3,770,002 | 11/1973 | Brown | 137/312 |
| 3,868,968 | 3/1975 | Fuhrmann | 137/624.18 |
| 3,874,403 | 4/1975 | Fischer | 137/387 UX |
| 4,069,837 | 1/1978 | Jirasek | 137/360 |
| 4,324,268 | 4/1982 | Jacobson | 137/312 |
| 4,418,712 | 12/1983 | Braley | 137/312 |
| 4,805,662 | 2/1989 | Moody | 137/312 |
| 5,029,605 | 7/1991 | Dowling et al. | 137/312 |
| 5,125,247 | 6/1992 | Mills | 137/312 |
| 5,156,190 | 10/1992 | Staley, Jr. | 137/312 |
| 5,240,022 | 8/1993 | Franklin | 137/312 |
| 5,240,028 | 8/1993 | Hoch, Jr. et al. | 137/312 |
| 5,402,815 | 4/1995 | Hoch, Jr. et al. | 137/312 |

*Primary Examiner*—George L. Walton
*Attorney, Agent, or Firm*—Fish & Richardson P.C.

[57] ABSTRACT

An electrically actuated flow control device for use with an electrical household appliance includes a single body defining first and second flow passages. Inlet ends of the flow passages connect to pressurized sources of hot and cold water, and outlet ends of the flow passages connect to hoses for delivery of hot and cold water to the appliance. Hot and cold water actuators are each adapted to move between a first position resisting flow through the flow passages and a second position permitting flow through the flow passages. A sensor detects whether current is being drawn by the appliance, and a controller controls the positions of the actuators dependant upon whether current is being drawn. The inlet ends of the flow passage each include a connector arranged at a desired spacing from each other corresponding to the connector spacing in a mechanical flow control device.

6 Claims, 7 Drawing Sheets

AUTOMATIC WATER SHUT-OFF VALVE

BACKGROUND OF THE INVENTION

This invention relates to automatic water shut-off valves for use with electric appliances.

Water flow automatic shut-off valve devices, e.g., for use with electric appliances such as clothes washers and dish washers, are employed to limit water damage due to ruptured hot water or cold water pressurized hoses when the appliance is not in operation.

Typically, a manually operated valve is provided for water shut off when the appliance is not in use. Also, Livingston U.S. Pat. No. 3,446,006 describes a device for monitoring electrical current flow to an appliance to automatically open separate valves placed between each of the flexible water supply hoses of an automatic clothes washer and the faucets to which they are connected when the appliance is actuated.

SUMMARY OF THE INVENTION

According to the invention, an electrically actuated flow control device for use with an electrical household appliance includes a single body defining a first flow passage and a second flow passage. An inlet end of the first flow passage connects to a pressurized source of hot water, and an outlet end of the first flow passage connects to a hose for delivery of hot water to the appliance. An inlet end of the second flow passage connects to a pressurized source of cold water, and an outlet end of the second flow passage connects to a hose for delivery of cold water to the appliance.

Hot and cold water actuators are each adapted to move between a first position resisting flow through the respective hot and cold flow passages and a second position permitting flow through the respective flow passages. A sensor detects whether current is being drawn by the appliance, and a controller controls the positions of the actuators dependent upon whether current is being drawn by the appliance.

Preferred embodiments of the invention may include one or more of the following features.

The inlet end of the first flow passage includes a hot water connector and the inlet end of the second flow passage includes a cold water connector; the hot water connector and the cold water connector are arranged at a desired spacing from each other corresponding to a connector spacing in a mechanical flow control device.

A second sensor senses water spillage from the hoses. The flow control device includes an electrical plug outlet for receiving an electrical plug of the electrical appliance, and an electrical plug for engagement in an electrical outlet.

According to another aspect of the invention, a method of replacing a mechanical flow control device with an electrically actuated flow control device includes disconnecting the mechanical flow control device from a hot water supply and a cold water supply and connecting the electrically actuated flow control device to the hot water supply and the cold water supply. The mechanical flow control device includes a body defining a hot water connector for attachment to the hot water supply and a cold water connector for attachment to the cold water supply, the hot water connector and the cold water connector being spaced on the body a predetermined desired distance. The electrically actuated flow control device includes a body defining a hot water connector for attachment to the hot water supply and a cold water connector for attachment to the cold water supply, the hot water connector and the cold water connector being spaced on the body the same predetermined desired distance as the spacing of the mechanical flow control device hot water connector and cold water connector.

Other features and advantages of the invention will be seen from the following description of a presently preferred embodiment, and from the claims.

DESCRIPTION OF THE PREFERRED EMBODIMENT

Figure 1:
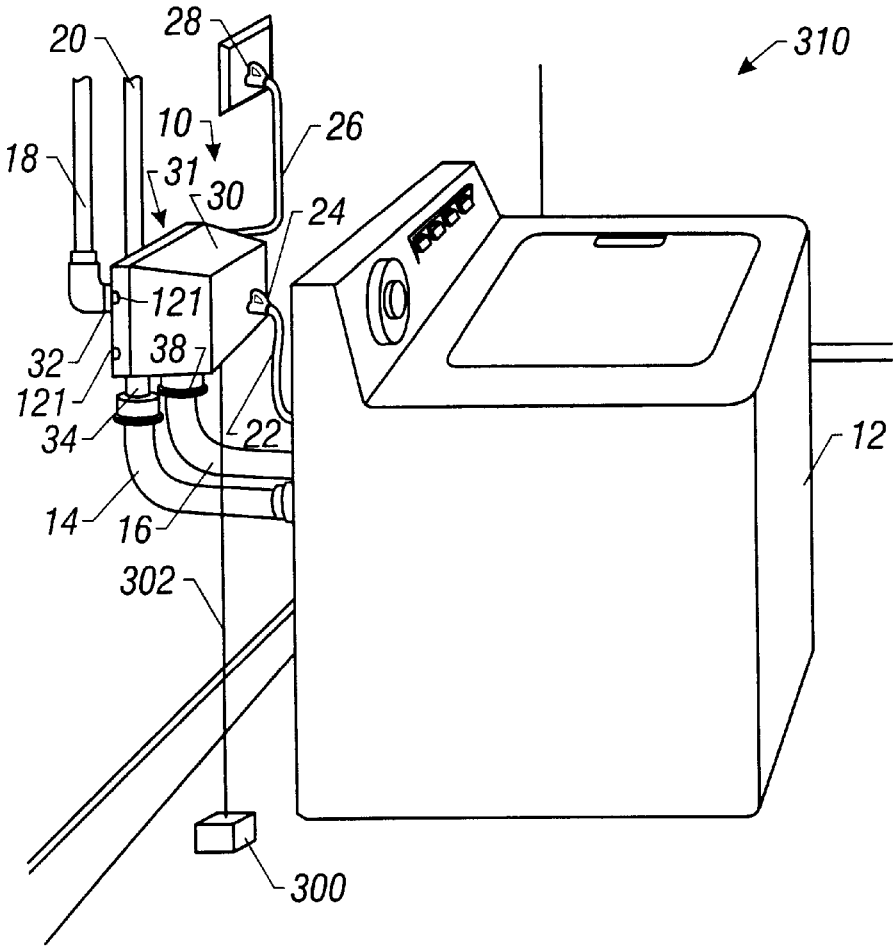
FIG. 1 is a perspective view of an electric washing machine equipped with a flow control device of the invention.

Referring to FIG. 1, an electrically actuated solenoid valve flow control device 10 of the invention is employed in connection with an electrical household appliance, e.g., a clothes washer 12. The clothes washer has hoses 14, 16 for connection to pressurized sources of hot water and cold water, e.g., pipes 18, 20, respectively. The clothes washer also has an electrical cord 22 which is plugged into an electrical outlet 24 of automatic flow control device 10. The automatic flow control device 10 also includes an electrical cord 26 which, in turn, is plugged into an electrical wall outlet 28 for delivery of electric current to power the clothes washer and the flow control device.

Figure 2:
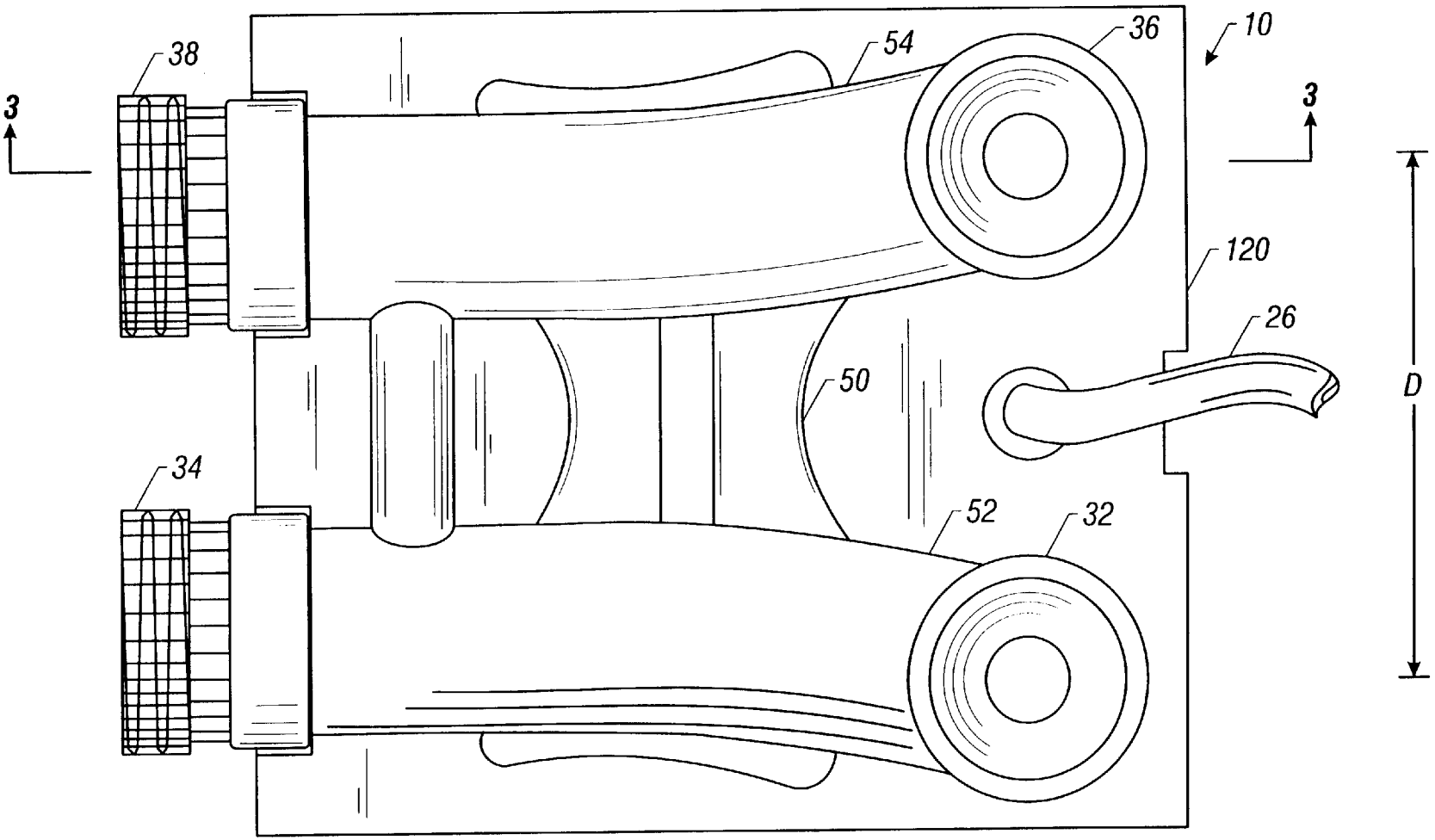
FIG. 2 is a view from the underside of the flow control device of the invention.

Referring also to FIG. 2, flow control device 10 includes a cover 30 mounted to a mounting plate 120 at underside 31 of flow control device 10 by four screws 121 (two screws being shown in FIG. 1). A body 50 located at underside 31 defines a first inlet 32 internally threaded for connection to hot water pipe 18, a first outlet 34 threaded externally for connection to hose 14 for delivery of hot water to clothes washer 12, a second inlet 36 internally threaded for connection to cold water pipe 20, and a second outlet 38 externally threaded for connection to hose 16 for delivery of cold water to the clothes washer. Body 50 defines hot and cold water flow lines 52, 54 terminating at inlet ends 32, 36 and at outlet ends 34, 38, respectively.

Figure 3:
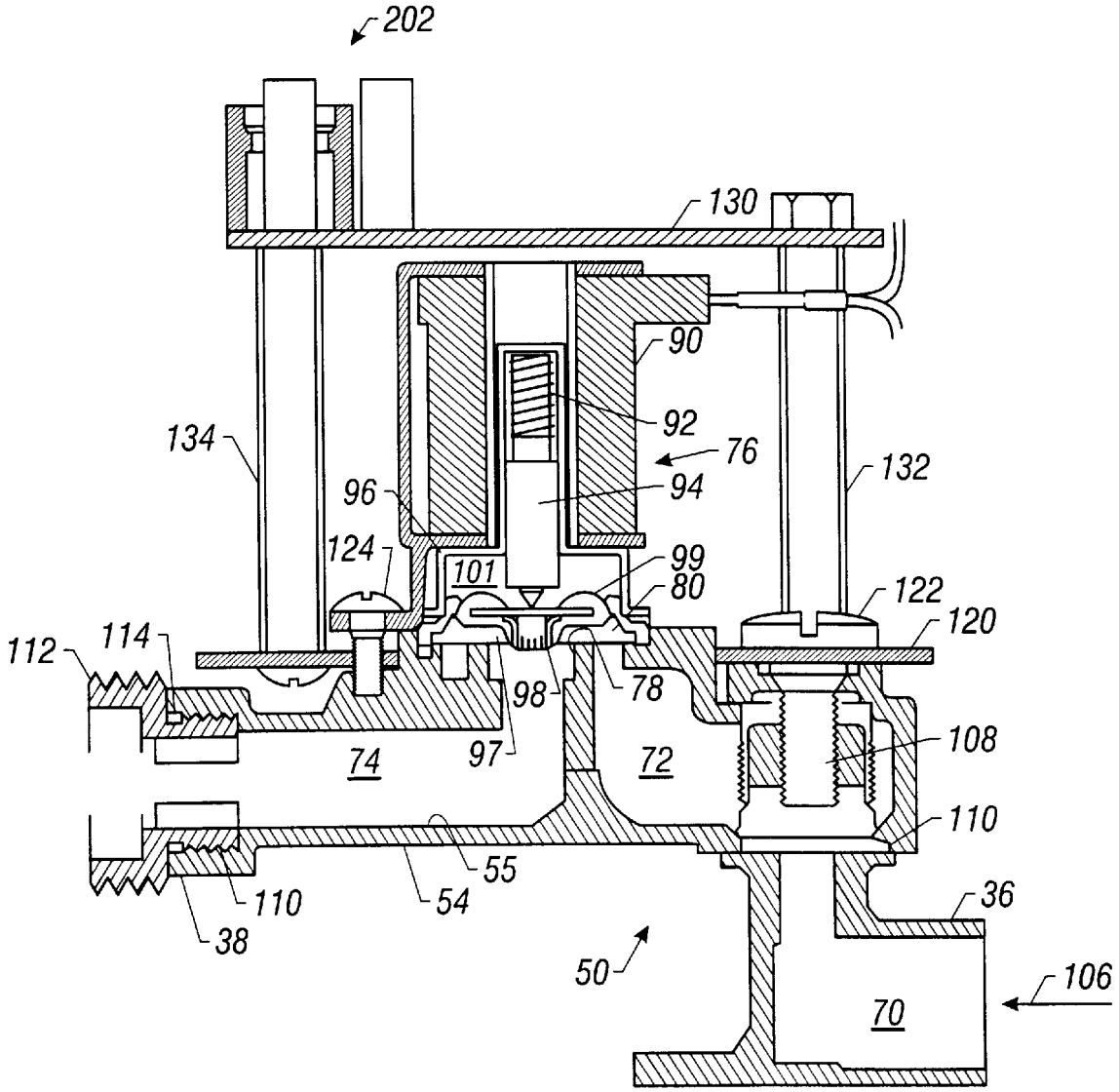
FIG. 3 is a sectional view of the flow control device of FIG. 2, taken along line 3—3, shown in an "ON" condition.
Figure 4:
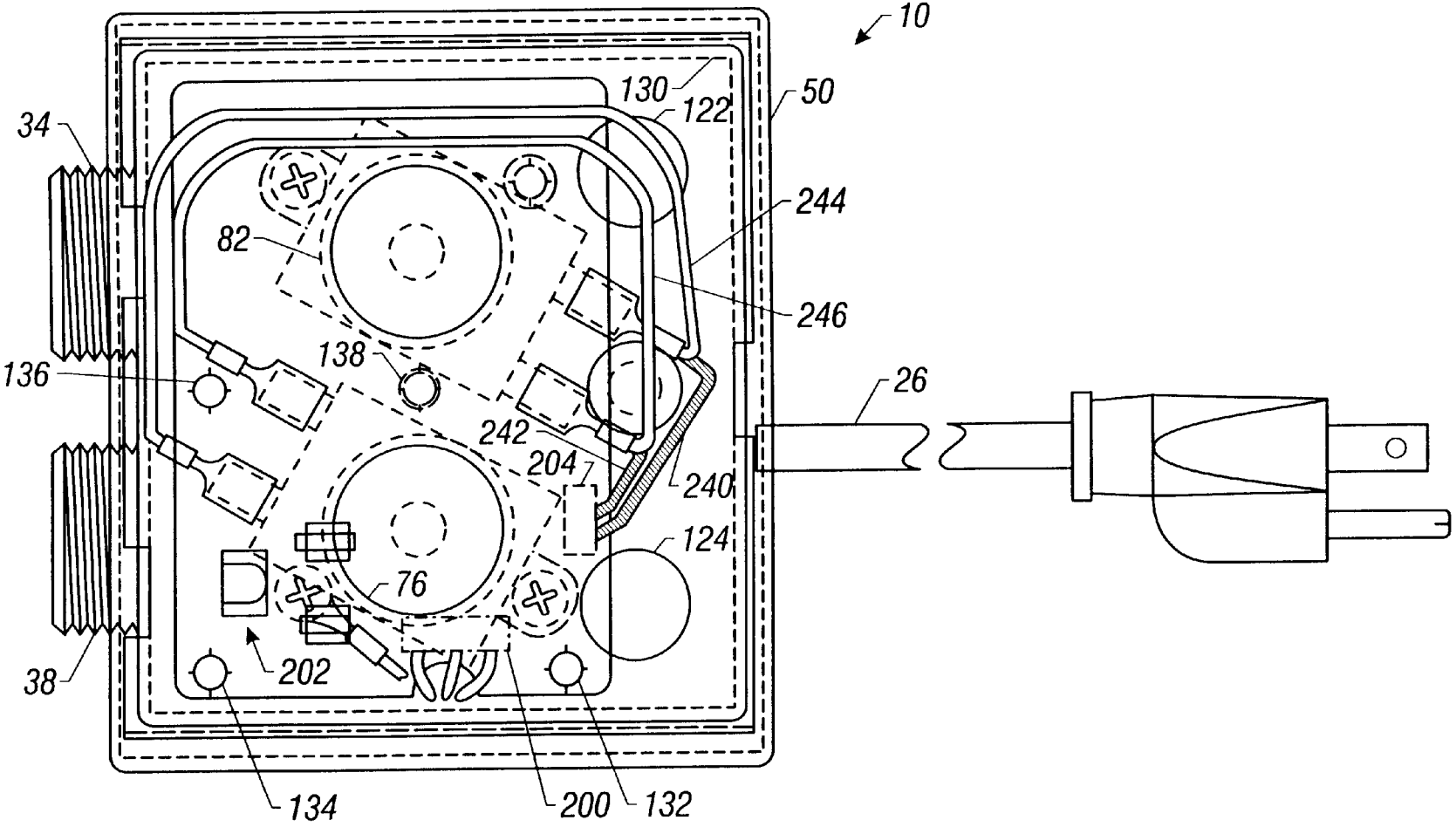
FIG. 4 is a top view of the flow control device shown with a cover removed.

Referring to FIG. 3, cold water flow line 54 defines a cold water channel 55, and hot water flow line 52 defines a hot water channel 53, not shown. The cold water channel 55, and, similarly, the hot water channel, are each divided in flow regions 70, 72, and 74. Referring also to FIG. 4, a cold water actuator 76 controls the flow of cold water (arrow 78) through a flow control region 80 between flow regions 72 and 74. A hot water actuator 82 similarly controls the flow of hot water through the hot water channel.

Figure 3A:
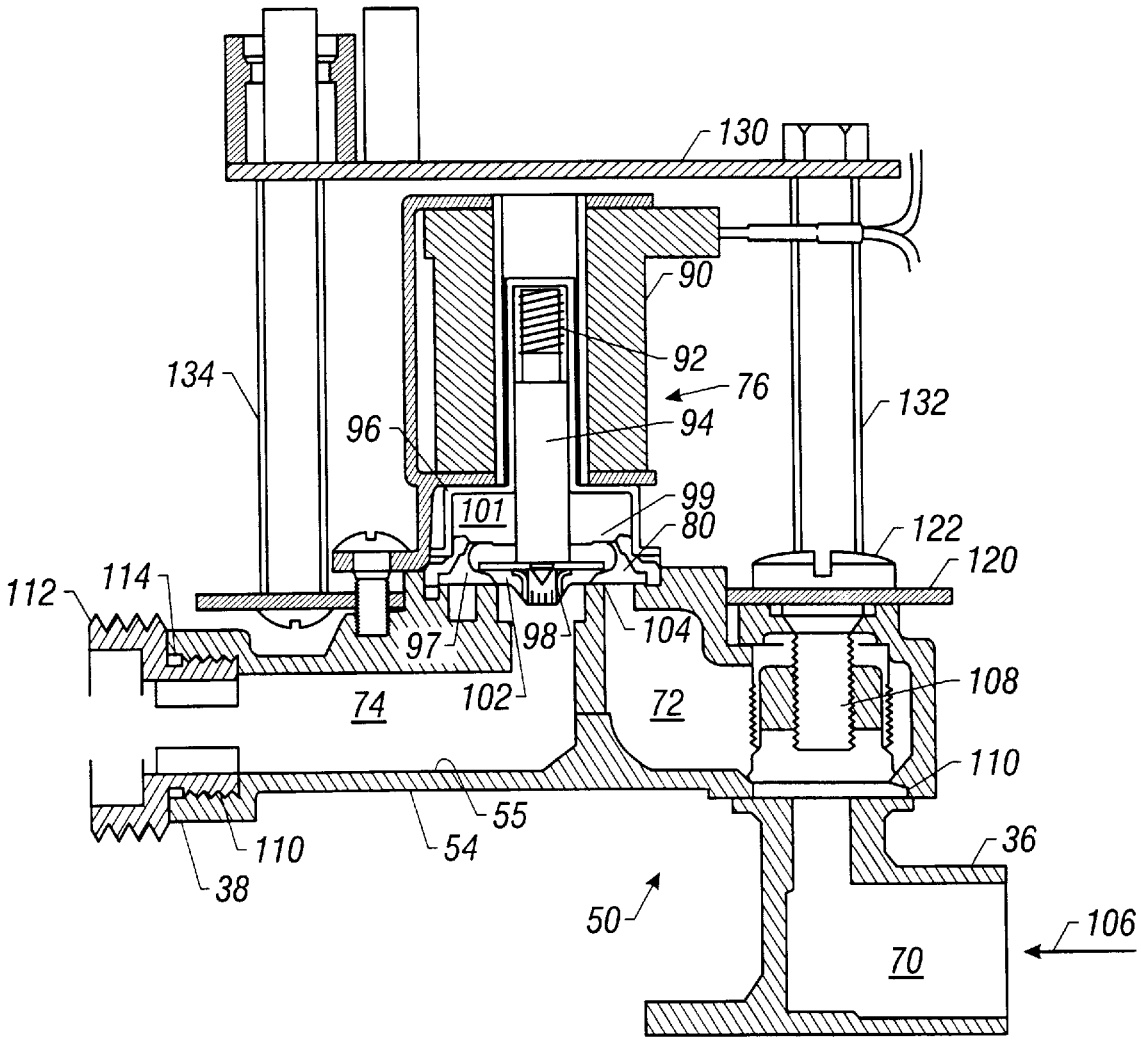
FIG. 3A is a similar sectional view of the flow control device of the invention shown in an "OFF" condition.

Flow control will now be described with reference to cold water flow channel 55, it being understood that flow control of the hot water channel is analogous. Actuator 76 includes a coil 90, a spring 92, an armature 94, and an armature housing 96. A diaphragm 97 positioned to lie on edges 102 and 104 of body 50 includes flow apertures 98 and 99. As shown in FIG. 3A, when coil 90 is not energized, spring 92 biases armature 94 toward a closed "OFF" position, blocking aperture 98. With inlet 70 connected to a water supply, water flows through aperture 99 in diaphragm 97. Water within a cavity 100, defined by armature housing 96, presses diaphragm 98 against body edges 102 and 104 to close flow control region 80.

As shown in FIG. 3, energizing coil 90 retracts armature 94 towards an open "ON" position. Water flows from cavity 100 through aperture 98, equalizing the pressure on either side of diaphragm 97. Water flow through flow regions 70 and 72 acts to lift diaphragm 97 of body edges 102 and 104, permitting flow through flow control region 80.

Water entering inlet 32 (arrow 106) passes through a strainer screen 108. An O-ring 110 seals screen 108 against body 50. Body 50 further defines a threaded bore 110 at outlet end 34 which accepts a hose adapter 112. An O-ring 114 seals hose adapter 112 against body 50.

Body 50 is connected to actuator 76, and similarly to actuator 82, by mounting plate 120. In particular, screw 122 fastens body 50 to mounting plate 120 and screw 124 fastens actuator 76 to mounting plate 120 and body 50.

Control electronics for detecting when the clothes washer 12 is drawing current and controlling the positions of cold and hot actuators 76, 82 are located on circuit board 130. Circuit board 130 is fastened to mounting plate 120 with screws 132, 134, 136 and 138 (see FIG. 4).

Figure 5A:
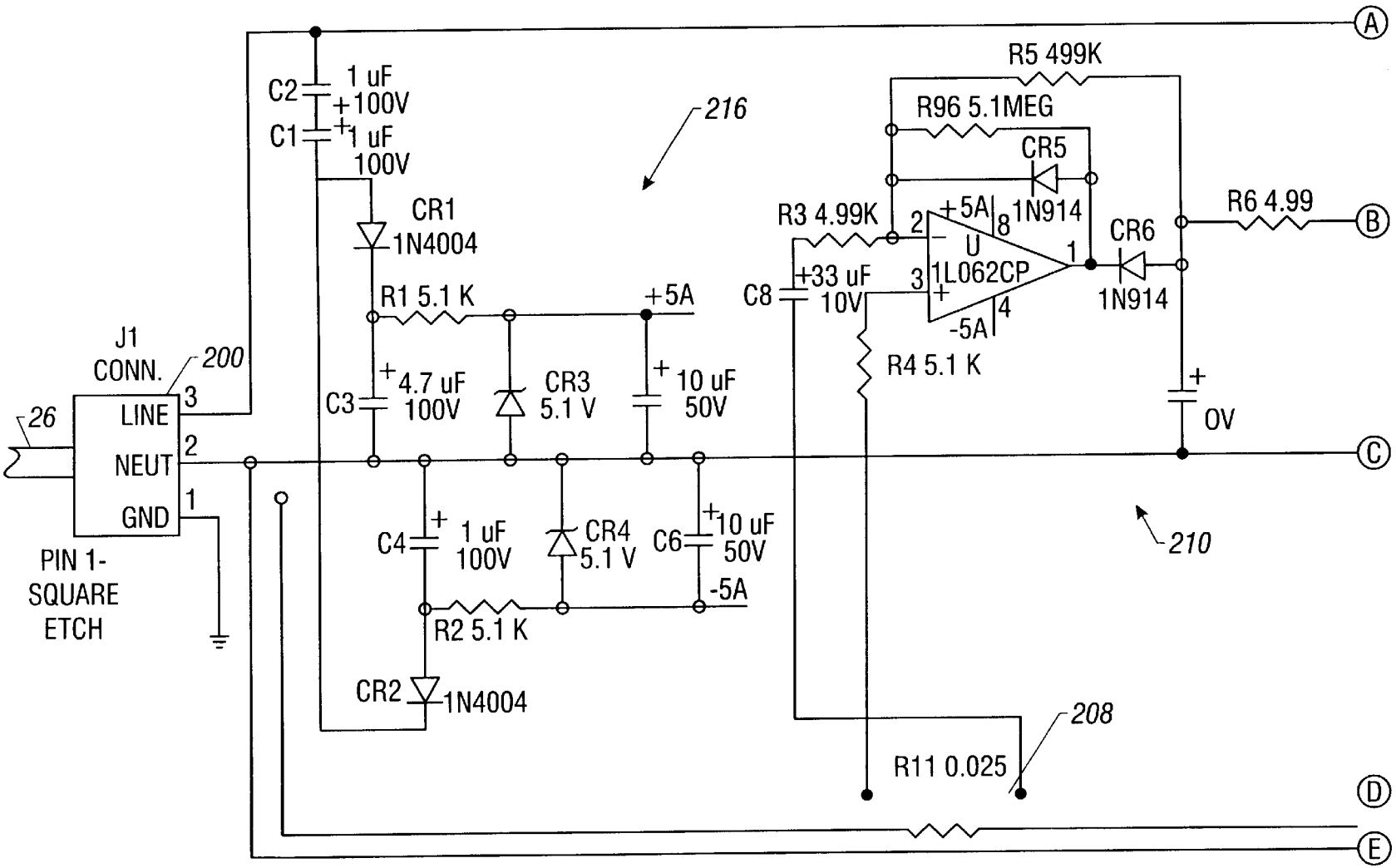
FIG. 5 is a schematic wiring diagram for the flow control device of the invention.
Figure 5B:
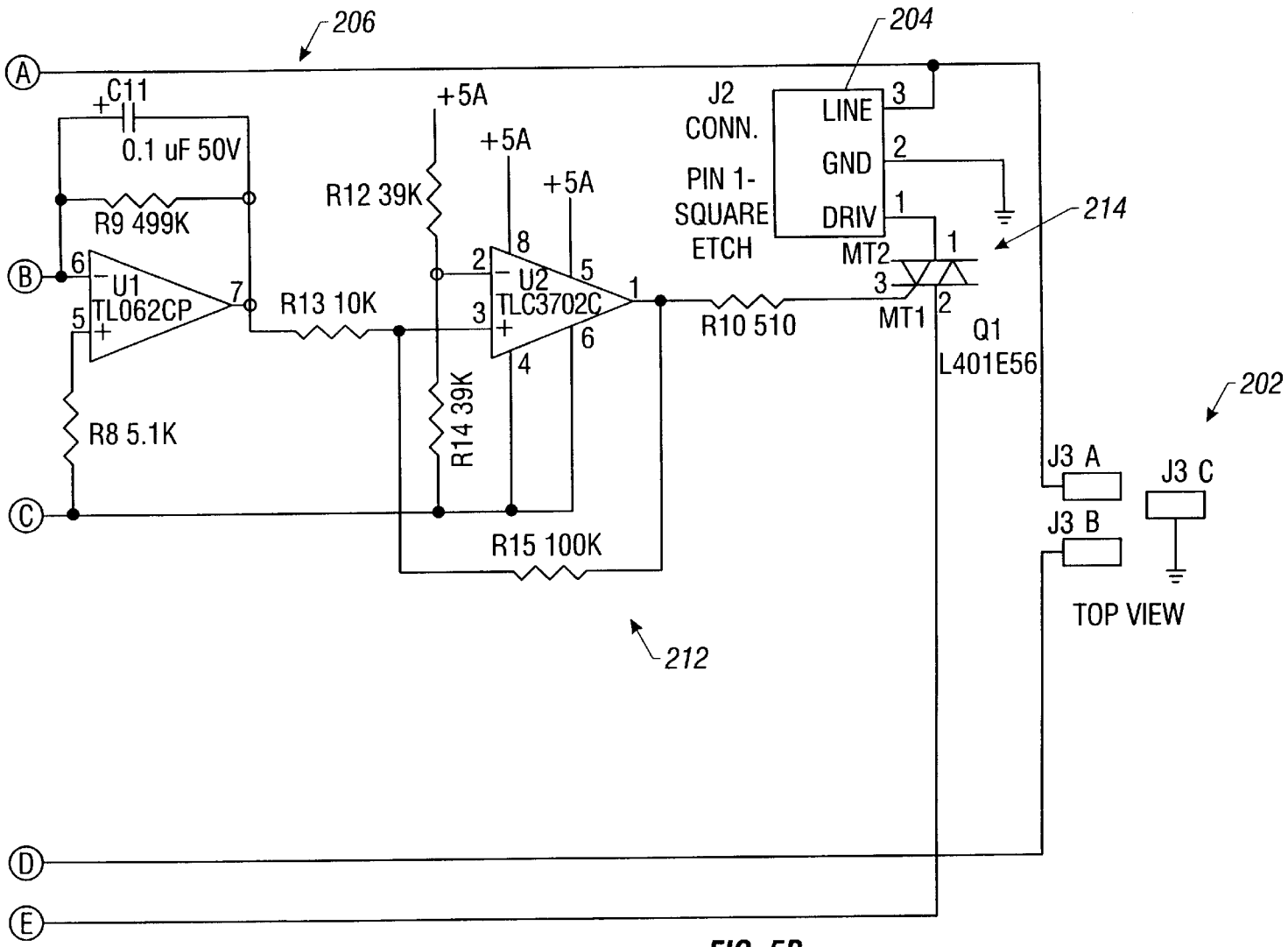

Referring to FIG. 5, electric circuitry 206 for detecting between a first condition of current being drawn by the clothes washer 12 and a second condition of absence of current being drawn by the clothes washer is located on circuit board 130. Power cord 26 is connected to a terminal block 200 to deliver power to circuit board 130. Power to clothes washer 12 is delivered through connectors 202, and power to actuators 76 and 82 is delivered through connector 204. Referring again to FIG. 4, from connector 204, power lines 240, 242 lead to actuator 82, and power lines 244, 246 split-off to actuator 76.

Electrical circuit 206 includes resistor 208, voltage drop sensor 210, comparator 212, triac switching relay 214, and power source 216. Triac switching relay 214 delivers power to actuators 76 and 82 only when a current draw to clothes washer 12 causes a drop in voltage across resistor 208, as measured by sensor 210.

In the presence of the first condition, i.e., current being drawn by the clothes washer, the actuators 76 and 82 move toward their first positions (shown in FIG. 3) to permit flow of hot water and cold water to the clothes washer 12.

Conversely, in the presence of the second condition, i.e., absence of current being drawn by the clothes washer 12, e.g., when a cycle is completed or if there is a loss of power, the electric circuitry 206 detects the lack of current flow and the actuators 76 and 82 move toward their second positions (shown in FIG. 3A), thereby to prevent flow of hot water and cold water to the clothes washer, thereby to prevent further water flow, such as might occur should one or both of the hoses 14, 16 rupture.

Referring again to FIG. 2, to enable ease of replacement of a mechanical shut-off valve, such as the No. 2 series DUO-CLOZ shut-off valve (Watts Regulator Company, North Andover, Mass.), with the automatic flow control device of the invention, the spacing, D, between hot and cold inlets 32 and 36, e.g., 2.38 inches, is selected to correspond to the spacing between the inlets of the mechanical valve.

Figure 6:
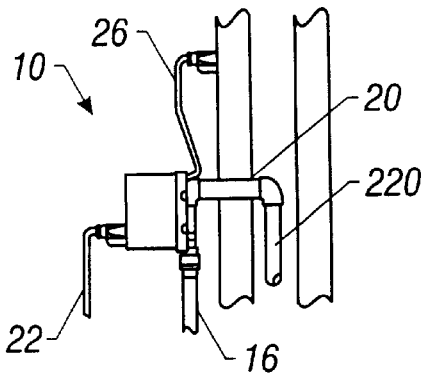
FIG. 6 shows an alternative mounting configuration of the flow control device.
Figure 6A:
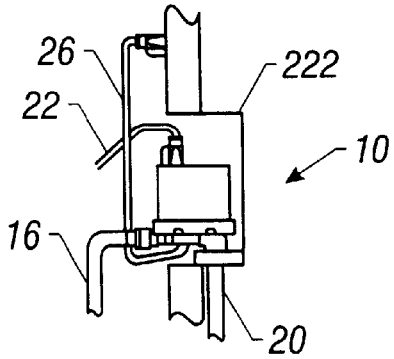
FIG. 6A shows an additional alternative mounting configuration of the flow control device.

Referring to FIGS. 6 and 6A, flow control device 10 can also be mounted to concealed piping 220 (FIG. 6) and within a recessed wall mount area 222 (FIG. 6A).

Referring again to FIG. 1, a remote moisture sensor 300, e.g., a resistance-type moisture sensor such as used in humidifiers, for determining the presence of water on floor 310, can be used in conjunction with flow control device 10 to prevent flow of hot and cold water to the clothes washer and turn-off power to the washer when moisture is sensed. Sensor 300 is connected to flow control device 10 by electrical line 302.

Other embodiments of the invention are within the following claims.

What is claimed is:

1. An electrically actuated flow control device for use with an electrical household appliance, said device comprising:

a single body defining a first flow passage and a second flow passage, said first flow passage including an inlet end and an outlet end, and said second flow passage including an inlet end and an outlet end, said inlet end of said first flow passage including a hot water connector for connection to a pressurized source of hot water, and said outlet end of said first flow passage for connection to a hose for delivery of hot water to the appliance, said inlet end of said second flow passage including a cold water connector for connection to a pressurized source of cold water, and said outlet end of said second flow passage for connection to a hose for delivery of cold water to the appliance, said pressurized source of hot water terminating in a hot water supply and said pressurized source of cold water terminating in a cold water supply, said hot water supply and said cold water supply being spaced a predetermined fixed distance from each other, said hot water connector and said cold water connector being arranged at a corresponding predetermined fixed distance from each other, a hot water actuator adapted for movement between a first position resisting flow through said first flow passage and a second position permitting flow through said first flow passage, a cold water actuator adapted for movement between a first position resisting flow through said second flow passage and a second position permitting flow through said second flow passage, a sensor for detecting a first condition of current being drawn by the electrical appliance for operation of the electrical appliance, and a second condition defining an absence of current being drawn by the electrical appliance during non-operation of the electrical appliance, and a controller for controlling the positions of said first actuator and said second actuator dependent upon said condition detected by said sensor, said controller, in the presence of said first condition, permitting flow of hot water and cold water to the electrical appliance and, in the presence of said second condition, resisting flow of hot water and cold water to the electrical appliance to limit water damage due to rupture of the hoses.

2. The electrically actuated flow control device of claim 1 further comprising a second sensor for sensing water spillage from the hoses.

3. The electrically actuated flow control device of claim 1, wherein said device further comprises an electrical plug outlet for receiving an electrical plug of the electrical appliance.

4. The electrically actuated flow control device of claim 1, wherein said device further comprises an electrical plug for engagement in an electrical outlet.

5. A method for replacing a mechanical flow control device with an electrically actuated flow control device, comprising:

disconnecting the mechanical flow control device from a hot water supply and a cold water supply spaced a predetermined fixed distance from each other, the mechanical flow control device including a body defining a hot water connector for attachment to the hot water supply and a cold water connector for attachment to the cold water supply, the hot water connector and the cold water connector being spaced on the body a corresponding predetermined fixed distance from each other, and connecting the electrically actuated flow control device to the hot water supply and to the cold water supply that the mechanical flow control device has been removed from, the electrically actuated flow control device comprising a body defining a hot water connector for attachment to the hot water supply and a cold water connector for attachment to the cold water supply, the hot water connector and the cold water connector being spaced on the body the same predetermined fixed distance from each other as the spacing of the mechanical flow control device hot water connector and cold water connector from each other.

6. The method of claim 5, wherein the step of connecting the electrically actuated flow control device further comprises providing said device comprising a single body defining a first flow passage and a second flow passage, said first flow passage including an inlet end and an outlet end and said second flow passage including an inlet end and an outlet end, said inlet end of said first flow passage for connection to a pressurized source of hot water, and said outlet end of said first flow passage for connection to a hose for delivery of hot water to the appliance, said inlet end of said second flow passage for connection to a pressurized source of cold water, and said outlet end of said second flow passage for connection to a hose for delivery of cold water to the appliance, a hot water actuator adapted for movement between a first position resisting flow through said first flow passage and a second position permitting flow through said first flow passage, a cold water actuator adapted for movement between a first position resisting flow through said second flow passage and a second position permitting flow through said second flow passage, a sensor for detecting between a first condition of current being drawn by the electrical appliance and a second condition of absence of current being drawn by the electrical appliance, and a controller for controlling the positions of said first actuator and said second actuator dependant upon said condition detected by said sensor, said controller, in the presence of said first condition, permitting flow of hot water and cold water to the electrical appliance and, in the presence of said second condition, resisting flow of hot water and cold water to the electrical appliance.

* * * * *